US008137205B2

(12) United States Patent
Cortelyou et al.

(10) Patent No.: US 8,137,205 B2
(45) Date of Patent: Mar. 20, 2012

(54) MOTION-BASED ATTRACTION

(75) Inventors: Robert J. Cortelyou, Orlando, FL (US); Steven C. Blum, Orlando, FL (US); Thierry Jean-Andre Coup, Windermere, FL (US); Brian McQuillan, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 110 days.

(21) Appl. No.: 12/630,911

(22) Filed: Dec. 4, 2009

(65) Prior Publication Data

US 2011/0136581 A1 Jun. 9, 2011

(51) Int. Cl.
*A63G 1/08* (2006.01)
*A63G 31/16* (2006.01)

(52) U.S. Cl. ..... 472/29; 472/60; 472/130; 434/55

(58) Field of Classification Search ..... 472/28–30, 472/36–38, 59–61, 130; 434/29, 30, 38, 434/40, 43, 44, 55
See application file for complete search history.

(56) References Cited

U.S. PATENT DOCUMENTS 3,542,934 A * 11/1970 Frizell et al. ..... 434/29
4,634,384 A * 1/1987 Neves et al. ..... 434/44
4,798,376 A 1/1989 Trumbull et al.
5,499,920 A * 3/1996 Trumbull ..... 434/69
5,567,157 A * 10/1996 Salmon et al. ..... 434/29
5,584,697 A 12/1996 Trumbull
5,708,527 A 1/1998 Adamson et al.
5,845,434 A * 12/1998 Hayashi ..... 52/9
6,042,382 A 3/2000 Halfhill
6,280,341 B1 * 8/2001 Hayashi ..... 472/61
6,665,985 B1 * 12/2003 Hennes ..... 52/7
2007/0009861 A1 1/2007 Heinrich
2010/0053029 A1 3/2010 Wilzbach et al.

OTHER PUBLICATIONS

PCT/US2010/041670; International Search Report and the Written Opinion, dated Apr. 4, 2011.

* cited by examiner

*Primary Examiner* — Kien Nguyen
(74) *Attorney, Agent, or Firm* — Fletcher Yoder

(57) ABSTRACT

The present disclosure provides a motion-based attraction device engagable with a plurality of spaced guest supports that are movable along a path, having a rotatable carousel configured to temporarily and separately synchronize with the plurality of spaced guest supports, at least one pair of domes supported by the carousel, each dome having a viewing portion that is positioned towards the guest supports and the dome being movable to temporarily cover the guest supports, and an image projecting assembly supported by each dome and configured to display an image on the viewing portion.

24 Claims, 6 Drawing Sheets

MOTION-BASED ATTRACTION

BACKGROUND

The present invention relates to theme park attractions. More particularly, the present invention relates to motion-based attractions including image viewing.

Simulators are used in a broad range of fields and for many different purposes. Flight simulators for the training of pilots and military simulators for the training soldiers are well known. Also well known is the use of simulators in the context of amusement park attractions. Generally, in this context, simulators include a motion base having one or more seats and a plurality of programmable actuators which displace the motion base from a rest position in accordance with a predetermined sequence of drive signals. The motion base movement is synchronized with a motion picture or story illuminated on a projection screen directly attached to the motion base or in the immediate environment.

For example, U.S. Pat. No. 4,798,376 describes a motion base that moves and tilts passengers viewing a motion picture. A plurality of passenger holding frames is provided which are all synchronously moved by separate sets of actuators. A film is shown to passengers on a stationary screen. The passenger holding frames are each pivoted up and down on a beam which is supported only by two largely vertical actuators while two pairs of links or arms limit the movement of the beam.

Some theme park attractions utilize rotational motion, (i.e., roll, pitch and yaw) correlated with a visual screen to produce a desired effect. For example, U.S. Pat. No. 5,584,697 describes a motion base for use with a attraction system having a system controller that generates command signals for presentation of a sequence of audio-visual image signals to a guest synchronously with the movement of the motion base. The motion base is inverted and has six degrees of freedom.

In many of the present theme park attractions, such as in the examples listed above, throughput is highly constrained because only a single set of individuals may participate in the simulation at one time. Furthermore, these attractions must contend with the situation in which guests may be moving along a path, into and out of a simulated environment. In the situation in which ingress and egress must be considered there must be a strict correlation between the guest vehicle and the visual images. Furthermore, during transition between different screens, guests may be exposed to undesirable views such as the edge of the screen frame and views at undesirable angles.

Therefore, it is desired to increase the throughput while also increasing the quality of viewing of images in a motion-based theme park attraction.

BRIEF DESCRIPTION

The present disclosure describes a motion-based attraction and a method for increasing guest throughput for a motion-based attraction.

In an embodiment, the invention provides a motion-based attraction device engagable with a plurality of spaced guest supports that are movable along a path comprising a rotatable carousel configured to temporarily and separately synchronize with the plurality of spaced guest supports, at least one pair of domes supported by the carousel, each dome having a viewing portion that is positioned towards the guest supports and the dome being movable to temporarily cover the guest supports, and an image projecting assembly supported by the dome and configured to display an image on the viewing portion.

In accordance with another embodiment of the present invention, a method for increasing guest throughput for a motion-based attraction device is provided. The method comprises providing a rotatable carousel having a plurality of domes for displaying an image on a viewing portion of the dome, moving plurality of guest supports along a path proximate the carousel, synchronizing each of the plurality of domes with each of the plurality of guest supports, wherein each of the images displayed on each of the domes begins at a time that is synchronized with each of the plurality of guest supports.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION

One embodiment of the present invention involves a motion-based attraction device having at least a pair of domes with a viewing portion positioned towards a guest support, the domes supported by a rotatable carousel. Two particular advantages afforded by this invention are the ability increase guest throughput while smoothing the transition of guest's visual fields during ingress and egress of the viewing portion.

Specific configurations and arrangements of the claimed invention, discussed below with reference to the accompanying drawings, are for illustrative purposes only. Other configurations and arrangements that are within the purview of a skilled artisan can be made, used, or sold without departing from the spirit and scope of the appended claims. For example, while some embodiments of the invention are herein described with reference to amusement park rides, a skilled artisan will recognize that embodiments of the invention can be implemented in any setting in which motion-based simulation is advantageous. For example, some non-limiting examples may include pilot and military training programs.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Attraction Synchronization

One embodiment of the present invention relates to a motion-based attraction device engagable with a plurality of spaced guest supports. The plurality of spaced guest support may comprise a vehicle, a watercraft, a robot arm attached to a guest carrier and the like. The guest supports may be movable along a path, such as on tracks or a laser guide. The plurality of domes are synchronized with the guest supports.

Figure 1:
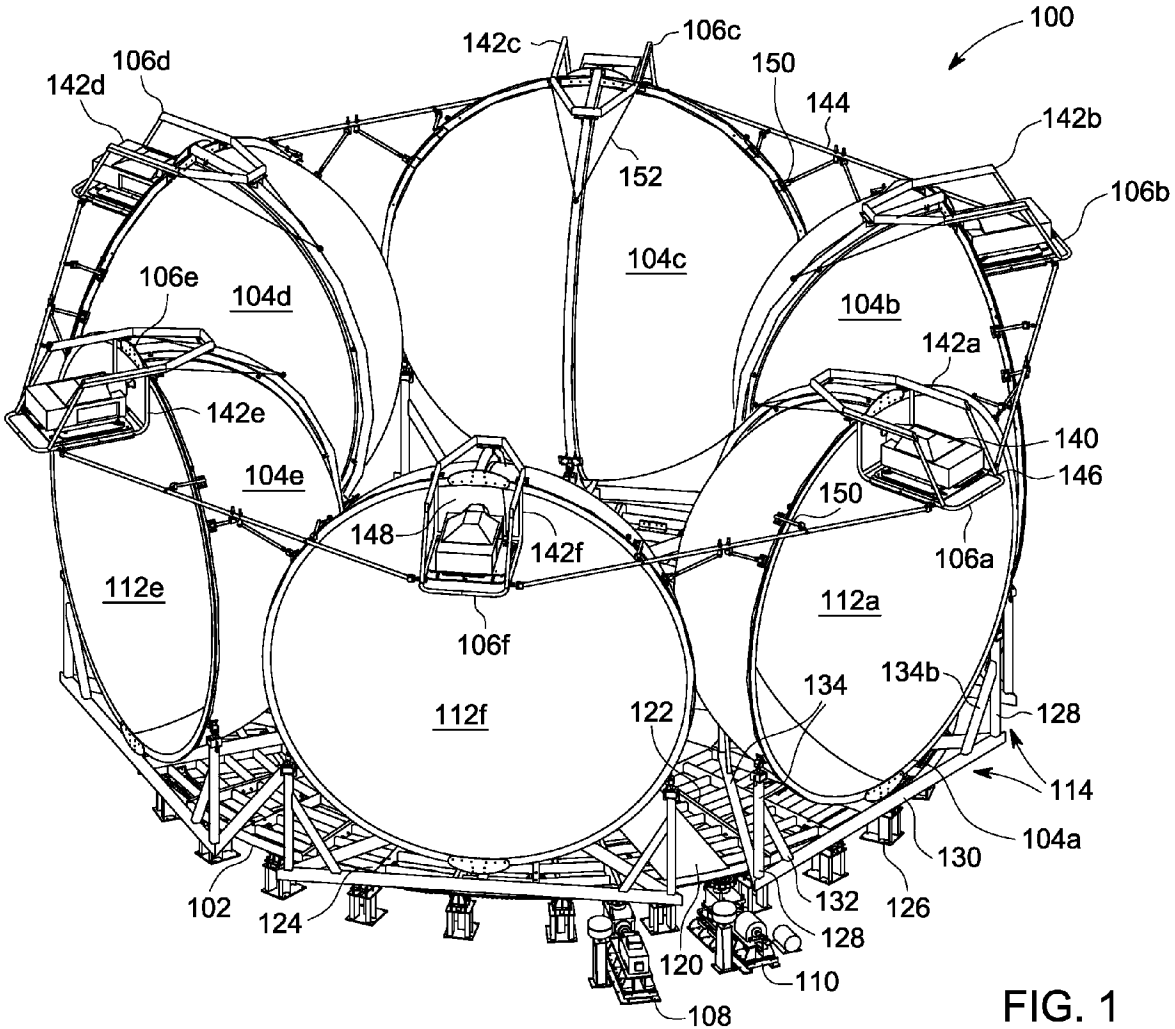
FIG. 1 is a perspective view of a plurality of domes supported by a rotatable carousel.

Referring now to FIG. 1, motion-based attraction device is shown generally at reference numeral 100. The motion-based attraction 100 may comprise a rotatable carousel 102, at plurality of domes 104, and an image projection assembly 106 for each dome 104 supported by the carousel 102.

In this embodiment, the carousel 102 is operated with a motor 108 such as an electric AC motor known in the art, configured to provide a sufficient rotational force to the carousel 102 to rotate at a desired speed. In this regard, the carousel is further provided with a braking assembly 110 configured to stop the carousel when a desired position is reached (e.g., during guest loading and unloading). The braking assembly 110 may comprise a disc braking system in which calipers are forced (e.g., hydraulically, pneumatically, electromagnetically, spring engaged) against both sides of the disc causing the drive axle to stop. It is to be appreciated that other braking assemblies may be applicable in the present invention (e.g., air brake, drum break, etc.). A clutch (not shown) may be further provided to smooth transitions.

The carousel 102 may be constructed from components suitably strong and durable such as composite or metallic substances, and may be chosen in a known manner, for example, based on strength, durability and mass. The carousel may comprise a sweep 120 extending radially out from a drive shaft at the hub (see FIG. 2) of the carousel 102, which will be discussed in greater detail with reference to FIG. 2. The sweep 120 may overlay a series of radial beams 122 which are traversed at an approximately an 80-90 degree angle by a series of struts 124, which may be positioned in a manner to provide stability for the domes 104 which are supported by the carousel 102. The carousel 102 may be supported by a plurality of blocks 126 which may be connected to a stable surface (e.g., ground, reinforced wall, ceiling) to bear the load of the carousel 102.

With further reference to FIG. 1, a plurality of domes 104 *a-f* is supported by the carousel 102. Each dome 104 *a-f* may comprise its own viewing portion 112 *a-f*, although only viewing portions 112 *a, e* and *f* can be seen in FIG. 1. The domes 104 may be one component of dome assemblies 114, which further comprise primary vertical support posts 128, secondary vertical support posts 132, primary horizontal support posts 130, and secondary horizontal support posts 134. Taken as whole, each of the support posts 128-134 combine to maintain the integrity of the domes 104 in their relative positions. For example, in the exemplary embodiment of the present invention shown in FIG. 1, primary vertical support posts 128 are attached to the non-viewing portion of the dome 104, such as on the outer surface of the dome 104. The vertical support posts 128 may be fixed to the dome 104 with, for example, bolts or welds, or in the alternative may be connected to the dome 104 by a bearing, such as hinge joint, if it desirable that the dome 104 be movable with respect to the carousel. The primary vertical support posts 128 are linked via a primary horizontal support post 130 which may be mounted to the carousel 102. Secondary horizontal support posts 134 are connected to the primary horizontal post 130 and the primary vertical support post 128 at a junction at a first end of the secondary horizontal support posts 134. The second end of each of the secondary horizontal support posts 134*a* and 134*b* are connected near the hub portion of the carousel 102 to form a triangular base for which the dome 104 to be positioned. Secondary vertical support posts 132 are connected to the primary horizontal support post 130 and the primary vertical support posts 128 to provide further stability to the dome assembly 114. It is to be appreciated that each support post may be bonded, welded, or generally fastened in a known manner. The domes may be manufactured fiberglass, carbon fiber, and the like.

In optional embodiments of the present invention, it may be desirable to move the dome in different directions, such as rotating and horizontally pivoted (i.e., tilting) to more accurately synchronize the image with the guest support. In this embodiment, the domes 104 may be connected to a hydraulic motor, which may raise the dome up and down as the dome rotates.

With further reference to FIG. 1, the motion-based attraction 100 further comprises an image projecting assembly 106 supported by the dome 104 and configured to display an image on the viewing portion 112 of the dome 104. As shown, each dome 104 *a-f* has a corresponding image projecting device 106 *a-f* for displaying an image on the viewing portion 112 thereof. The image projecting assembly 106 may comprise a digital projector 140, a frame 142 and braces 144.

As shown, in the exemplary embodiment of FIG. 1, the digital projector 140 is supported by a frame 142 which is connected to a top portion of the dome 104. The frame 142 may be composed of alloyed metals linked together (i.e., via bond, weld) to securely retain the digital projector 140 thereon. The frame 142 is positioned having a hanging bottom portion 146 and an aperture 148. The digital projector 140 is positioned facing the aperture 148 and is configured to project an image on the viewing portion 112 of the dome 104. Each of the frames 142 *a-f* are further connected to the other with braces 144, which are further connected to the domes 104 with brace weldments 150.

Figure 2:
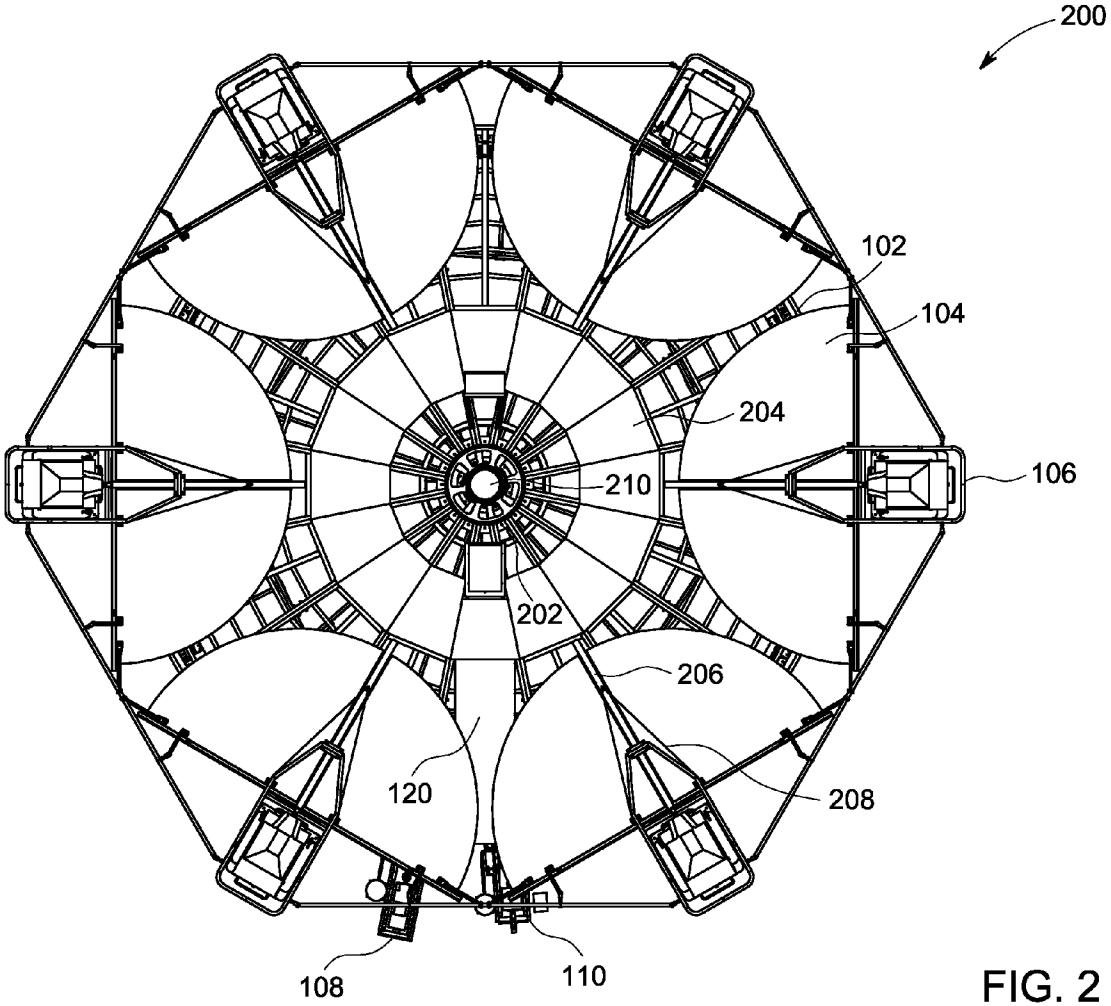
FIG. 2 is an overhead diagram of the plurality of domes supported by the carousel of FIG. 1.

Now with reference to FIG. 2, a is an overhead diagram of the plurality of domes 104 supported by the carousel 102 of FIG. 1 is shown generally at 200. As can best be seen in FIG. 2, as shown in this exemplary embodiment, the carousel 102 is generally hexagonal in shape, and in this way, can accommodate six domes 104. It is to be appreciated that more of less domes 104 may be desirable, and that the shape of the carousel 102 may change therewith. The carrousel 102 further comprises a hub 202, a shell 204, a dome spine 206 and cables 208. The cables 208 connect the dome spine 206 to the frame 142 for additional support. The sweep 120 extends radially out from a drive shaft 210 of the carousel and is configured to at least partially enclose the drive mechanisms from the motor 108 and the braking assembly 110. A series of radial beams 122 extend from the hub 202 and are traversed by struts 124 which run circumferentially around the hub 204 to the periphery of the carousel 102 to form a mesh-like network. In an optional embodiment of the present invention, the domes 104 may moveable (i.e., biased in multiple directions). In this embodiment, the dome spines 206 and cables 208 provide support during motion.

Figure 3:
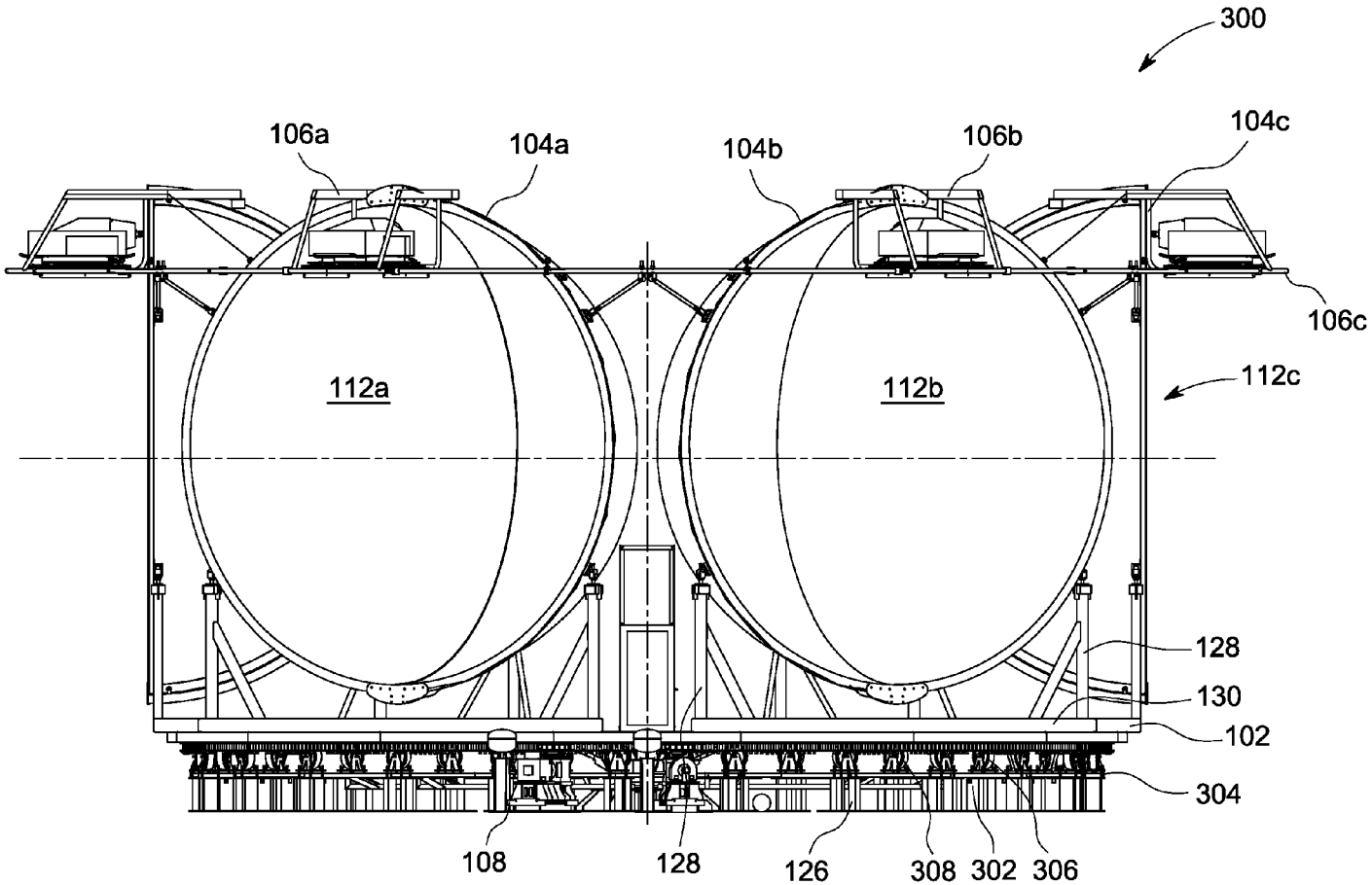
FIG. 3 is a side view of the plurality of domes supported by the carousel of FIGS. 1 and 2.

Now with reference to FIG. 3, a side view of the plurality of domes 104 supported by the carousel 102 of FIGS. 1 and 2 is shown at reference numeral 300. In this particular view, three domes 104 *a-c* supported by the carousel 102 are shown, each dome having an image projecting assembly 106 *a-c*, which projects an image on the viewing portion 112 *a-c*. The primary vertical support posts 128 are attached to the non-viewing portion of the dome 104. The vertical support posts may be connected to the dome 104 by a bearing, such as hinge joint, if it desirable that the dome be movable with respect to the carousel 102. The primary vertical support posts 128 are connected to primary horizontal support post 130, which may be mounted to the carousel 102.

As can best be seen in FIG. 3, the undercarriage of carousel 102 further comprises a plurality of casters 302, which are fixed to a guide 304, the guide 304 being ultimately supported by posts 126. The caster wheels 306 are dimensioned to correspond to a belt 308 attached to an underside of the carousel 102. In this way, the motor 108 may be configured to drive the drive axle (not shown), the casters wheels 306 acting as a guide providing rotational motion to the carousel 102.

In another embodiment of the present invention, the invention provides a method for increasing guest throughput for a motion-based attraction comprising providing a rotatable carousel having domes supported thereby, moving a plurality of guest supports along a path proximate a carousel, and synchronizing the domes and the guest supports.

Figure 4:
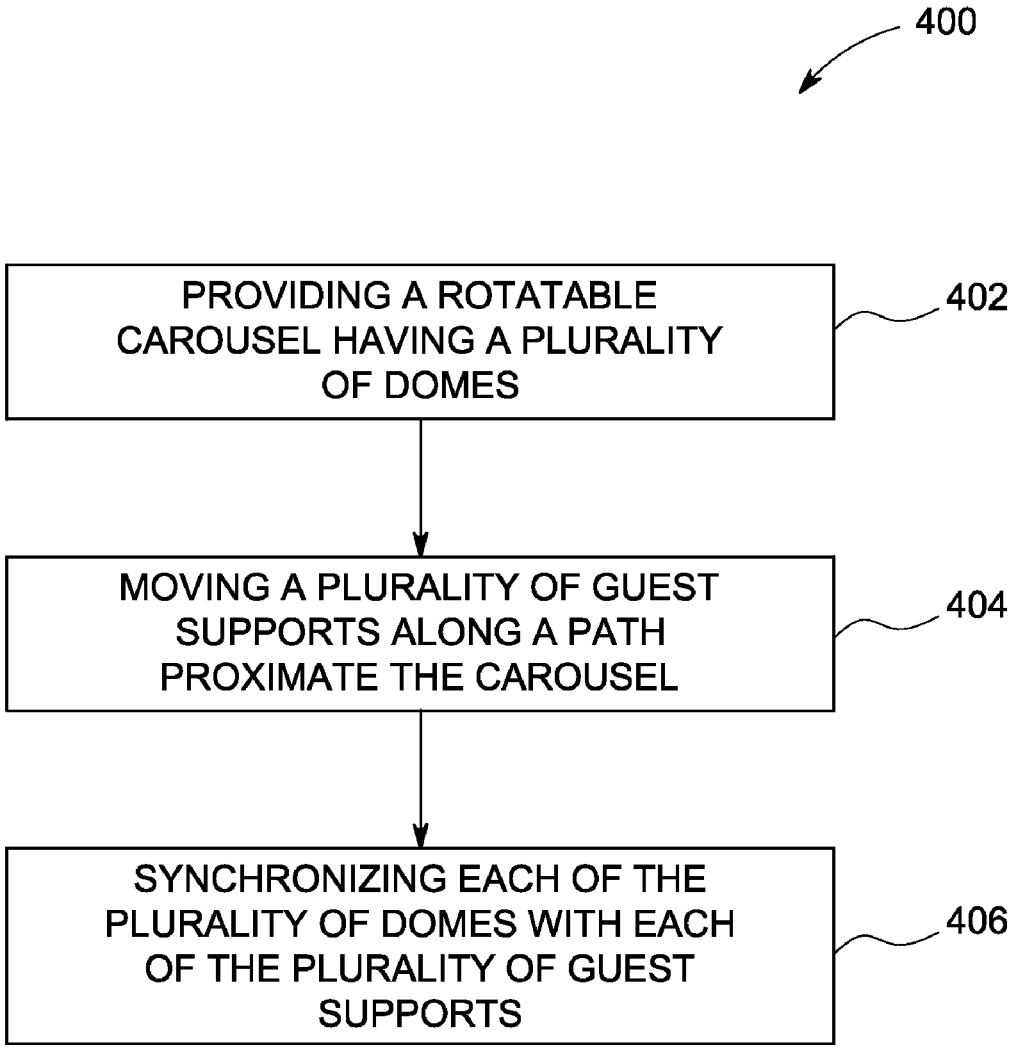
FIG. 4 is a flow-chart describing a step-wise method in accordance win a further embodiment of the present invention.

Referring now to FIG. 4, there is shown a flow chart to better help illustrate a method for increasing guest throughput for a motion-based attraction device generally at 400. While the flowchart shows an exemplary step-by-step method, it is to be appreciated that a skilled artisan may rearrange or reorder the steps while maintaining like results.

Providing a rotatable carousel having a plurality of domes for displaying an image on a viewing portion of the dome step 402 comprises providing a device such as the exemplary device shown in FIGS. 1-3. Generally, such a device may comprise a rotatable carousel, at plurality of domes, and an image projection assembly for each dome, the device being proximate a guest support device, which will be discussed in greater detail with reference to FIG. 5.

Moving a plurality of guest supports along a path proximate the carousel step 404 may comprise providing a pair of tracks for the guest support to reside on. In other embodiments of the present invention, motion may be provided to the guest support via flowing water down a path, or by laser guided automotive-type vehicles which may be laser-guided.

Synchronizing each of the plurality of domes with each of the plurality of guest supports step 406, wherein each of the images displayed on each of the domes begins at a time that is synchronized with each of the plurality of guest supports may comprise providing hardware and software so that the carousel and dome assemblies are in communication with guest supports, particularly regarding location and progress of each guest support with relation to the dome assembly.

The synchronization step increases guest throughput by allowing guests to view stones at different times. For example, in previous known attractions, a guest or a group of guests enter a support, and story or video narrative may begin. The next group of guests may not enter until the story has ended, perhaps 2-3 minutes later. Therefore, only one group of guests can be serviced at a time (e.g, twenty guests per three minutes session). However, in an exemplary embodiment of the present invention, each group of guests can view the story beginning at different times. For example, a group of guest may enter a first guest support and begin to move around a track. One of the domes can then be synchronized with the guest support via the carousel so that the guests in the guest support can view the story on the viewing portion of the dome, which begins at an appropriate time. After the first guest support leaves a loading area, a second group of guests may enter a second guest support and begin to move around the track. A second dome can then be synchronized with the guest support via the carousel so that the guests in the guest support can view the story on the viewing portion of the dome, which begins at an appropriate time specific to that dome. In this way, even if a story is over three minutes, a different group of guests may be serviced every thirty seconds to one minute (approximately equal to loading and unloading time), as they do not need to wait for the first group to watch the story in full.

In optional embodiments of the present invention, synchronizing each of the plurality of domes with each of the plurality of guest supports 406, may further comprise moving the dome together with the carousel. For example, it may be desirable to move the dome in different directions, such as rotating and horizontally pivoted (i.e., tilting, biasing) to more accurately synchronize the image with the guest support. In this embodiment, the domes 104 may be connected to a hydraulic motor.

Undesirable View Reduction During Transition

Figure 5:
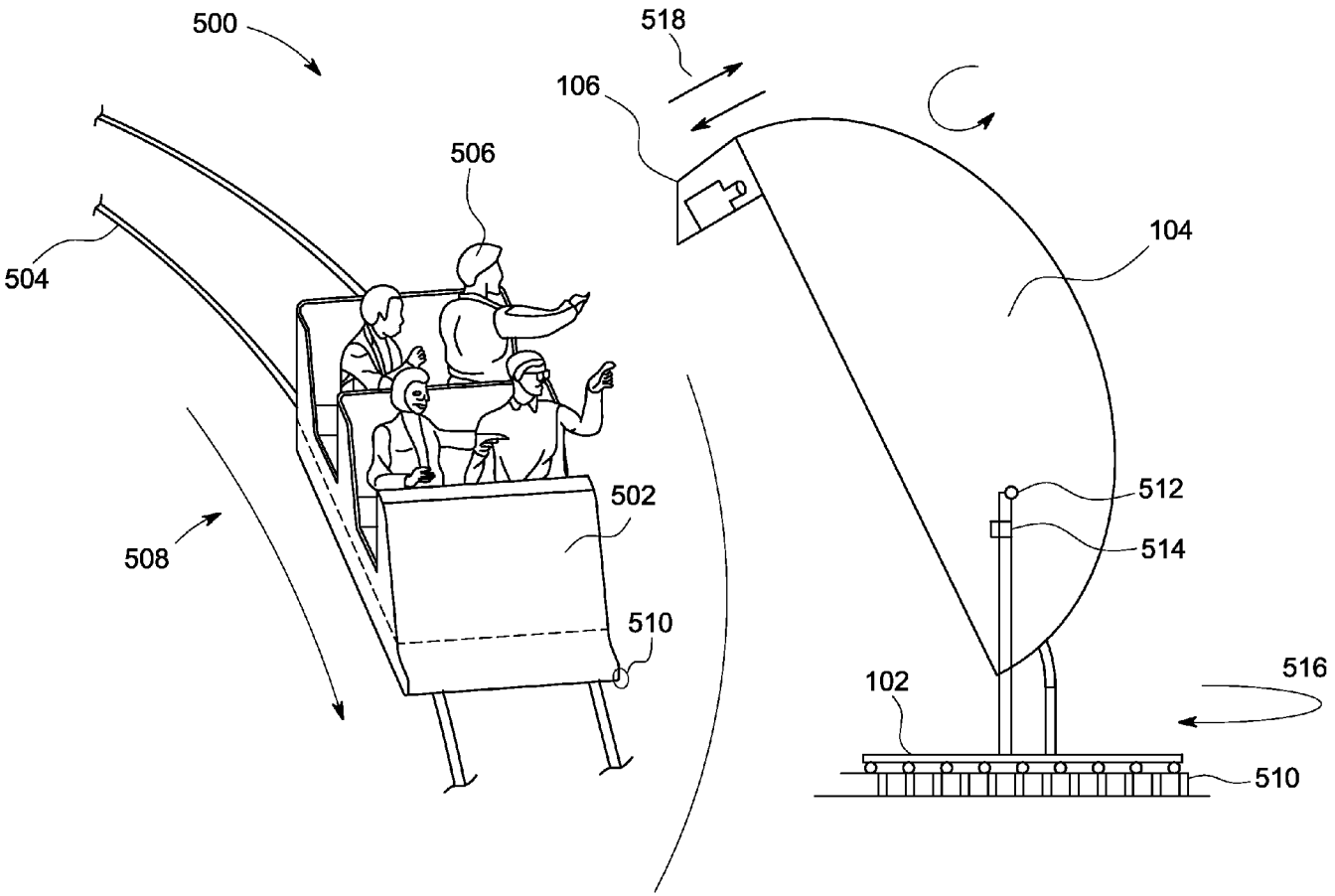
FIG. 5 is a perspective view of a motion based attraction device in accordance with one embodiment of the invention.

In another embodiment of the present invention, a motion-based attraction device for adjusting an image based on a transition period during an ingress and egress of the guest support relative a dome to minimize undesirable views such as the edge of the screen to the guests during the transition period is shown with respect to FIG. 5. Generally, in known attractions with projected images, as guests move with respect to a stationary image, the image will appear to change shape. For example, when guests move on tracks in a guest support, as they approach an imaging device, the image may appear lengthened relative the imaging surface, and as they become closer to the image, the image will apparently shorten relative the imaging surface, thus making the feel of the attraction less realistic.

Referring now to FIG. 5, a perspective view of a guest support 502 residing on tracks 504 carrying a group of guests 506 is shown in relation to a dome assembly 104 supported by a carousel 102 and having an image projecting assembly 106 is shown generally at 500. The guest support 502 comprises track position sensors 510 which may be in communication with the carousel 102 and the dome 104 through a central processing unit (e.g., microprocessor, controller, main computer, etc.). In this regard, the carousel and dome may also comprise a series of carousel sensors 510 on the carousel 102 to sense carousel position and dome sensors 512 on the dome 104 to further sense dome position. The controller or processor provided is configured to automatically shift the position of the carousel 102 and the dome 104 with relation to the guest support 502 so that the dome 104 shifts in a way such that a guest enjoys a smooth transition during ingress and egress as the guest support moves down the track 504 as shown by arrow 508. For example, a central processor (not shown) may be in communication with the guest support vehicle 502, the carousel 102, the dome 104, the imaging projecting assembly 106, the motor 108, and the dome actuator 514 (e.g., via sensors 510, 512).

The central processor may be configured to automatically signal the motor 108 to rotate the carousel 102 depending upon the position of the guest support 502 as shown by arrow 516. The central processor may also activate the dome actuator 514, which is configured to tilt the dome relative to the position of the guest support 502 as shown by arrows 518. In this way, the guests 506 may never observe undesirable views such as the edge of the image screen because even as the guests are approaching the dome 104 the imaging portion of the dome (see FIGS. 1-3) will be the guest's point of view. Furthermore, due to dome rotation, the image distortion that typically occurs on ingress and egress (e.g., lengthening and shortening) is no longer a concern. The image (i.e., the story) may, in this respect, follow the guest around the track 504 producing desirable viewing angles throughout the duration of the ride.

In another embodiment of the present invention, a motion-based attraction device is engagable with a plurality of spaced guest supports that are movable along a path and comprises a rotatable carousel proximate a moving guest support, at least one dome supported by the carousel, the dome having a viewing portion that is positioned towards the guest support, and an image projecting assembly supported by the carousel and configured to display an image on the viewing portion wherein the image projecting assembly is configured to adjust the image as the guest move into and out of the dome assembly. The device in this embodiment may be one as shown in FIGS. 1-3. The image projecting assembly, such as shown in FIG. 1-3 identifiable by reference numeral 106 comprises a digital projector 140. The digital projector may be configured to adjust the image as the guests move into and out of the dome assembly.

Figure 6:
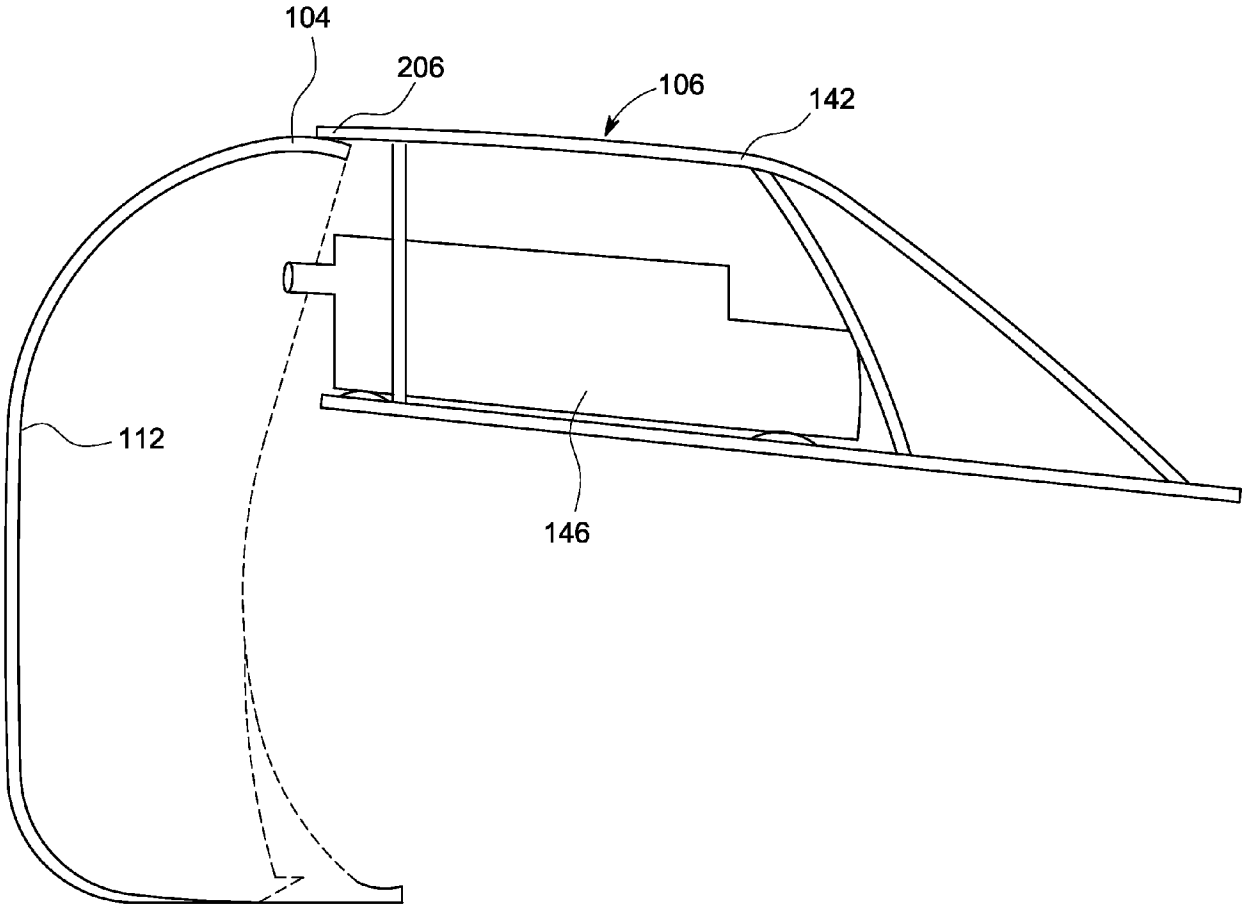
FIG. 6 is side view of the image projecting assembly in accordance with one embodiment of the present invention.

As shown with reference to FIG. 6, an exemplary image projecting assembly is shown. The image projecting assembly 106 is attached to the dome 104 and configured to display an image on the viewing portion 112 of the dome 104. The digital projector 140 is supported by a frame 142, which is connected to a top portion of the dome 104 through the dome spine 206. The frame 142 may be composed of alloyed metals linked together (i.e., via bond, weld) to securely retain the digital projector 140 thereon. The frame 142 is positioned having a hanging bottom portion 146 and an aperture 148. The digital projector 140 is positioned facing the aperture 148 and is configured to project an image on the viewing portion 112 of the dome 104.

In optional embodiments of the present invention, it is to be appreciated that many other optical and mechanical special effects may be incorporated herein and used separately or in tandem. For example, a wind element or odor element may be introduced to the dome (or guest support). It is to be further appreciated that the while in the exemplary embodiment shown in FIGS. 1-3 and 5-6 domes are used as the imaging surface for image viewing, the imaging surface may be of any desirable shape and size, such as a flat screen supported and movable by the carousel.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

Although specific features of various embodiments of the invention may be shown in some drawings and not in others, this is for convenience only. In accordance with the principles of the invention, the feature(s) of one drawing may be combined with any or all of the features in any of the other drawings. The words "including", "comprising", "having", and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

What is claimed is:

1. A motion-based attraction device engagable with a plurality of spaced guest supports that are movable along a path, comprising:

a rotatable carousel configured to temporarily and separately synchronize with the plurality of spaced guest supports;

at least one pair of domes supported by the carousel, each dome having a viewing portion that is positioned towards the guest supports and the dome being movable to temporarily cover the guest supports; and an image projecting assembly supported by each dome and configured to display an image on the viewing portion.

2. The motion-based attraction device of claim 1, wherein the guest supports comprise a ride vehicle, a floating vessel, or a suspended seat.

3. The motion-based attraction device of claim 1, wherein the guest supports are movable on tracks or are laser guided.

4. The motion-bases attraction device of claim 1, further comprising a motor connected to a drive axle of the carousel and configured to rotate the carousel bi-directionally.

5. The motion-based attraction device of claim 4, further comprising a braking assembly connected to the drive axle.

6. The motion-based attraction device of claim 1, further comprising a plurality of casters engagable to an underside of the carousel, wherein the casters are attached to a guide.

7. The motion-based attraction device of claim 1, wherein the carousel comprises radial beams extending outwardly from a hub, the radial beams being traversed by horizontal struts running circumferentially around the hub to form a mesh network.

8. The motion-based attraction device of claim 1, wherein the carousel is supported by a plurality of blocks connected to a ground, wall or ceiling.

9. The motion-based attraction device of claim 1, wherein the at least one pair of domes is manufactured with composite fiberglass or carbon fiber.

10. The motion-based attraction device of claim 1, further comprising a dome assembly configured to structurally support each dome, the dome assembly comprising:

a pair of primary vertical support posts connected to an outer surface of the dome;

a primary horizontal support post mounted to the carousel and positioned to link each of the primary vertical support posts;

a pair of secondary horizontal support posts connected to each of the primary vertical support post and the primary horizontal support post at a junction at a first end, the pair of secondary support post being connected to the other at a second end proximate a hub of the carousel; and a pair of secondary vertical support posts connected to the primary horizontal support post and each of the primary vertical support posts.

11. The motion-based attraction device of claim 1, wherein the domes further comprise a dome spine.

12. The motion-based attraction device of claim 1, further comprising a dome actuator configured provide at least two degrees of movement to the dome.

13. The motion-based attraction device of claim 12, wherein the dome actuator comprises a hydraulic motor.

14. The motion-based attraction device of claim 1, wherein the image projecting assembly comprises a digital projector supported by a frame, wherein the frame is connected to a top portion of the dome and comprises a hanging bottom portion and an aperture, the digital projector being positioned facing the aperture to project an image on the viewing portion of the dome.

15. The motion-based attraction device of claim 1, further comprising a series of sensors attached to each of the guest support, the dome assembly, and the image projecting assembly.

16. The motion-based attraction of claim 15, further comprising a processor in communication with the series of sensors.

17. A method for increasing guest throughput for a motion-based attraction device, the method comprising:

providing a rotatable carousel having a plurality of domes for displaying an image on a viewing portion of the dome;

moving plurality of guest supports along a path proximate the carousel;

synchronizing each of the plurality of domes with each of the plurality of guest supports, wherein each of the images displayed on each of the domes begins at a time that is synchronized with each of the plurality of guest supports.

18. The method of claim 17, wherein:

the carousel comprises a motor and a brake assembly;

the guest supports comprise a ride vehicle movable on tracks; and the plurality of domes are connected to a dome assembly supported by the carousel.

19. The method of claim 17, comprising the step of providing an image projecting assembly comprising a digital projector supported by a frame, wherein the frame is connected to a top portion of the dome and comprises a hanging bottom portion and an aperture, the digital projector being positioned facing the aperture to project an image on the viewing portion of the dome.

20. The method of 17, wherein synchronizing each of the plurality of domes with each of the plurality of guest supports comprises providing a series of sensors attached to each of the guest support, the dome assembly, and the image projecting assembly.

21. The method of claim 20, wherein synchronizing each of the plurality of domes with each of the plurality of guest supports further comprises providing a processor in communication with the series of sensors.

22. The method of claim 17, wherein synchronizing each of the plurality of domes with each of the plurality of guest supports further comprises:

synchronizing a first guest support with a first dome;

displaying an image on a viewing portion of the first dome in the form of a story;

synchronizing a second guest support with a second dome;

displaying an image on a viewing portion of the second dome in the form of the story.

23. The method of claim 17, wherein synchronizing each of the plurality of domes with each of the plurality of guest supports further comprises providing a dome actuator configured to provide at least two degrees of movement to the dome, wherein the dome is configured to partially encapsulate the guest support.

24. The method of claim 23, wherein the dome actuator comprises a hydraulic motor.

* * * * *